US005083337A

United States Patent [19]

Jones

[11] Patent Number: 5,083,337

[45] Date of Patent: Jan. 28, 1992

[54] DISPOSABLE CLEANING IMPLEMENT

[76] Inventor: Marlene M. Jones, 342 Lake Vue Park, Montgomery, N.Y. 12549

[21] Appl. No.: 715,579

[22] Filed: Jun. 14, 1991

[51] Int. Cl.[5] ..... A47L 25/00

[52] U.S. Cl. ..... 15/104.94; 15/105; 15/118; 15/185; 206/205; 206/223

[58] Field of Search ..... 15/104.94, 105, 118, 15/185; 206/205, 223, 229

[56] References Cited

U.S. PATENT DOCUMENTS 4,309,469 1/1982 Varona .
4,362,781 12/1982 Anderson .
4,575,891 3/1986 Valente .
4,941,226 7/1990 Kemper ..... 15/185
4,974,763 12/1990 Widrig ..... 15/105
5,025,524 6/1991 Genovese, Jr. ..... 15/104.94

*Primary Examiner*—Edward L. Roberts
*Attorney, Agent, or Firm*—Terry M. Gernstein

[57] ABSTRACT

A hand-held implement can be used to clean various surfaces and is totally self-contained. The implement includes a sponge element that is impregnated with disinfectant and a drying cloth mounted on a head section thereof. A handle section of the implement folds over the head section during storage. A disposal bag unit is mounted on the sponge and also serves to prevent the disinfectant from evaporating from sponge during storage. A packet of dry cleaning powder is also mounted on one of the handle sections. After, use, the implement is placed in the disposal bag and discarded.

8 Claims, 5 Drawing Sheets

DISPOSABLE CLEANING IMPLEMENT

TECHNICAL FIELD OF THE INVENTION

The present invention relates to the general art of hand tools, and to the particular field of cleaning implements.

BACKGROUND OF THE INVENTION

Many people have, at one time or another, required the use of a public restroom. While most public restrooms are quite clean, some are not as clean as all users may want. While some of this variation in cleanliness requirements may be due to simple fastidiousness, some of the requirement many be a result of fear. With the recent increase in communicable diseases, many people ar simply afraid to use a public restroom.

These people can avoid such public facilities most of the time; however, there may be times when use of a public restroom is unavoidable. In such a situation, it would be helpful, and comforting, for the user to be able to clean that portion of the restroom that he or she will be using.

While there are many cleaning tools suited for use in cleaning a restroom, most of these tools are not well adapted for use in such special situations as just described. It is simply too cumbersome and inconvenient to carry any form of such cleaning implements about. It is also not desirable to have such implements stored in a public restroom. Therefore, there is a need for a highly portable cleaning implement which can be easily and conveniently carried about by a user, yet which permits that user to effect a thorough cleaning of a portion of a public restroom.

In order to maintain the most sanitary conditions possible, an implement used to clean a restroom or some portion thereof, should be discarded after a single use. Plural uses of such cleaning tools may present a possibility of transferring germs from one place to another, or from the item being cleaned to the user. However, it is not practical to dispose of most presently-available cleaning devices that can be used in a restroom after only a single use. It may be too expensive to dispose of such tools after only a single use, or it may not be convenient to effect such disposal. Therefore, there is a need for a cleaning tool that is amenable to a single use in a restroom yet can be disposed of in an effective manner while still being economical.

OBJECTS OF THE INVENTION

It is a main object of the present invention to provide a portable hand tool that is suitable for cleaning a restroom or parts thereof.

It is another object of the present invention to provide a portable hand tool that can be used to clean a restroom and includes all of the items necessary to effect a thorough cleaning.

It is another object of the present invention to provide a portable hand tool that can be used to clean a restroom and is amenable to disposal after a single use.

It is another object of the present invention to provide a portable hand tool that can be used to clean a restroom and can be conveniently disposed of after use.

It is another object of the present invention to provide a portable hand tool that can be used to clean a restroom and is amenable to disposal after a single use yet will still be economical and practical.

SUMMARY OF THE INVENTION

These, and other, objects are achieved by a portable cleaning implement that can be easily disposed of after a single use.

The cleaning implement includes a handle that folds up into a carrying or storage case and which also serves to mount a portion of the cleaning equipment. The implement also includes a disposal bag which serves a dual purpose of preventing disinfectant on a sponge from evaporating during storage and of containing the cleaning implement after use for disposal. The device further includes a cloth for wiping surfaces dry and a packet of dry cleaning powder. The cleaning powder packet is attached to one portion of the handle and has dispensing openings defined in one wall thereof.

The entire device is quite small when the handle is folded, and can be conveniently carried on a user's person or can be dispensed from a vending machine in the restroom.

BRIEF DESCRIPTION OF THE DRAWING FIGURES

DETAILED DESCRIPTION OF THE PREFERRED EMBODIMENT OF THE INVENTION

Figure 1:
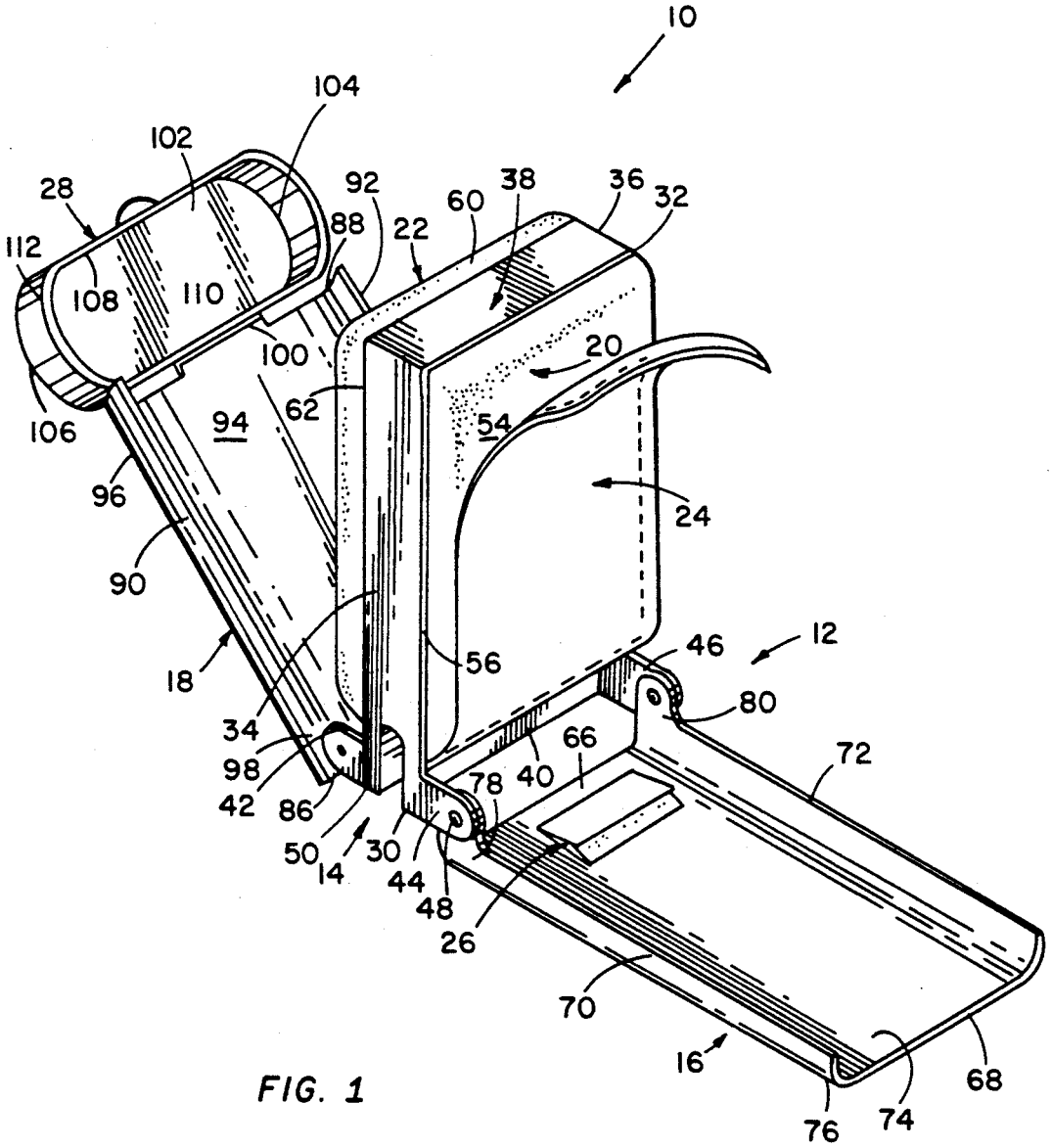
FIG. 1 is a perspective view of the cleaning implement of the present invention in a partially open configuration.

Shown in FIG. 1 is a cleaning implement 10 that is amenable to convenient storage and can be disposed of after a single use. The implement 10 contains all of the elements necessary to effect a thorough cleaning, yet is still economical even if used only one time. The implement 10 can also be dispensed from a vending machine if desired.

The implement 10 includes a handle unit 12 that has a head section 14 attached to front and rear cover sections 16 and 18 respectively. The implement 10 further includes a sponge element 20 and a drying cloth 22 mounted on the head section, with a bag unit 24 releasably attached to the sponge element to cover that sponge. The bag unit 24 is fixed to the sponge in an air-tight manner to prevent disinfectant contained in the sponge unit from evaporating during storage. The bag unit serves a dual purpose of preventing evaporation of the disinfectant and containing a used cleaning implement for disposal. A packet 26 is also included and contains dry cleaning powder. A top unit 28 is pivotally attached to the handle unit to close the implement during storage.

More specifically, the handle unit head section 14 includes a first end edge 30, a second end edge 32 and two side edges 34 and 36 connecting the end edges together. A wall 38 is attached to the head section at the side edges and the second end edge. The head section further includes a front surface 40 and a rear surface 42, with two front hinge ears 44 and 46 being fixed to the front surface adjacent to the first end edge 30. Each front hinge ear includes a pivot pin,, such as pivot pin 48 in ear 44, connected thereto at a distal end thereof. Likewise, two rear hinge ears, such as hinge ear 50, are connected to the rear surface 42 adjacent to the first end edge 30. The rear hinge ears also have pivot pins attached thereto at a distal end thereof.

The sponge element 20 is fixed to the front surface 40 and is contained within the wall 38 with an outer surface 54 projecting beyond the wall front rim 56. As mentioned above, the sponge element contains a liquid disinfectant. A dry cleaning cloth 60 is mounted on the rear surface 42 to project above the wall rear rim 62.

The handle unit further includes the front cover unit 16 that includes a first end edge 66,, a second end edge 68, and two curved side edges 70 and 72 connecting the first and second edges 66 and 68 together. The front cover also includes an inner surface 74 and an outer surface 76, and two hinge ears 78 and 80 are connected to the front cover inner surface adjacent to the first end edge 66. The hinge ears 78 and 80 are pivotally connected to the hinge ears 44 and 46 respectively by the pivot pins 48. The front cover moves between an open position shown in FIG. 2 and a closed position covering the sponge element. The cover is shown in a partially open position in FIG. 1.

The handle unit further includes the rear cover unit 18 that includes a first end edge 86, a second end edge 88, and two curved side edges 90 and 92 connecting the first and second edges 86 and 88 together. The front cover also includes an inner surface 94 and an outer surface 96, and two hinge ears, such as hinge ear 98 are connected to the rear cover inner surface adjacent to the first end edge 86. The hinge ears 98 are pivotally connected to the hinge ears 50 by the pivot pins, such as pivot pin 48. The rear cover moves between an open position shown in FIG. 2 and a closed position covering the cloth element 22. The cover is shown in a partially open position in FIG. 1.

The top unit 28 is pivotally attached to the rear cover unit second end edge 88 by a living hinge 100. The hinge 100 is formed of a material that can be bent back and forth several times without breaking. Therefore, the hinge is described as being a "living hinge." The top unit 28 includes a bottom wall 102 having two ends 104 and 106 and two side edges 108 and 110 connecting the ends together, with the hinge 100 connected to the side edge 110. A side wall 112 is connected to the bottom wall edges and extends outwardly of that bottom wall. The living hinge 100 permits the top unit to move between a first position shown in FIG. 1 with the bottom wall generally co-planar with the rear cover unit inner surface 94 and a second position having the top unit bottom wall extending at a generally right angle with respect to that inner surface 94 toward the front cover unit. In the second position of the top unit, the top unit side wall surrounds the two cover units and the wall 34.

Figure 2:
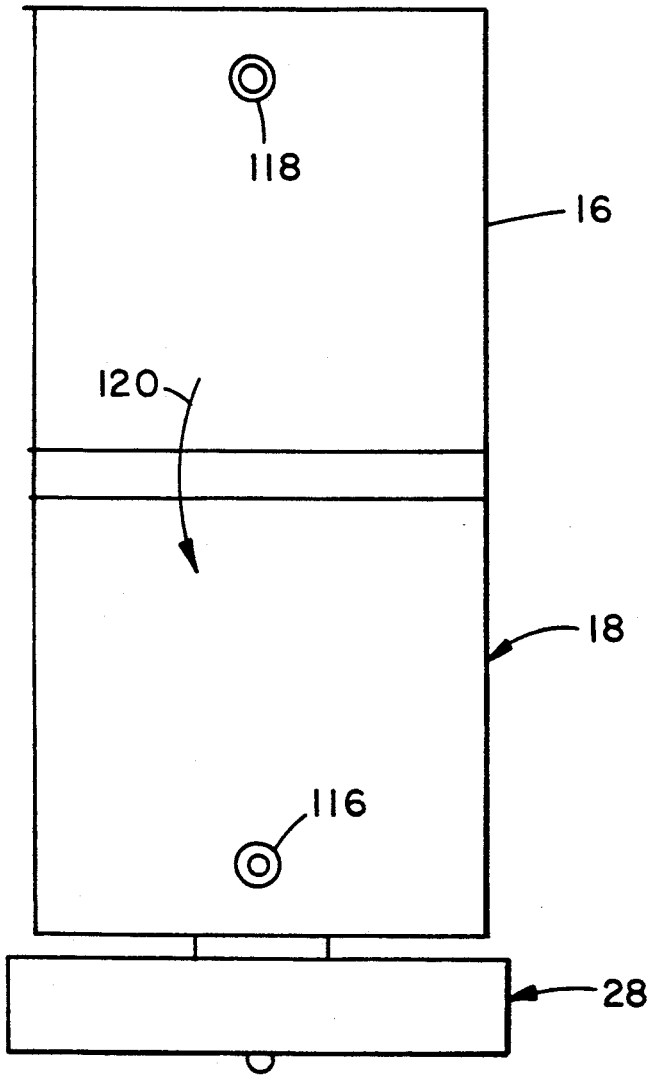
FIG. 2 is a rear elevational view thereof in a fully open configuration.

As best shown in FIG. 2, the implement includes a locking means for locking the front cover unit to the rear cover unit when the implement is in the open condition. The locking means includes a male snap element 116 on the outer surface of the rear cover unit 18 and a female snap element 118 on the outer surface of the front cover unit 16. The implement is fully opened when the front cover unit 16 is moved in direction indicated by arrow 120 to engage the snap elements together.

Figure 3:
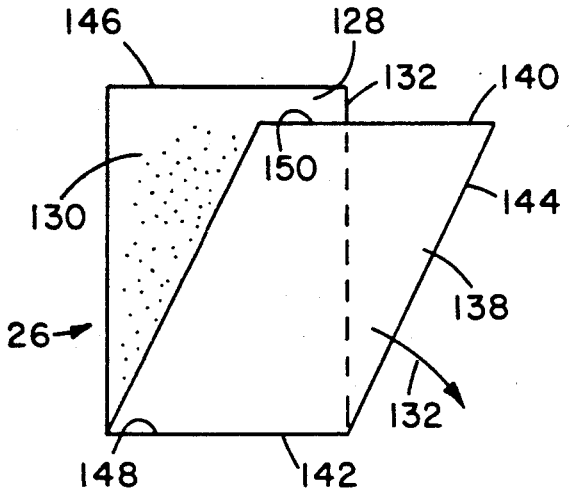
FIG. 3 illustrates a dry powder packet of the implement in a partially open configuration.
Figure 4:
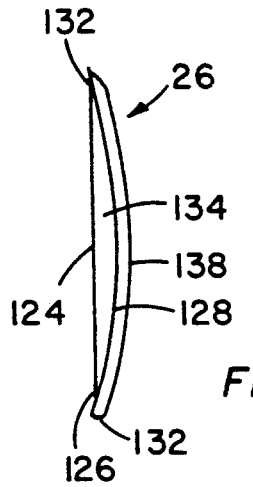
FIG. 4 is a side elevational view of the powder packet in the closed configuration.

Referring to FIGS. 1, 3 and 4, the packet 26 for containing and dispensing dry powder, such as abrasive cleanser, or the like, is shown as including a rear surface 124 having adhesive 126 thereon for attaching the packet to the cover unit, a front surface 128 having a multiplicity of dispensing holes 130 defined therethrough. The front and rear surfaces 124 and 128 are connected together along their edges 132 to define a packet pocket 134 in which the soap powder is stored. A front flap 138 includes a top end edge 140 and a bottom end edge 142 and two side edges 144. The flap top end edge is coincident with top end edge 146 of the packet and the flap bottom end edge is coincident with packet bottom end edge 148, while the flap side edges are coincident with the packet side edges 132. Adhesive 150 is located on the flap adjacent to the flap top edge and releasably attaches the flap to the packet to close the dispensing holes 130. Releasing the flap and moving it away from the packet as indicated in FIG. 3 by arrow 152, opens the dispensing holes so soap powder can be dispensed onto a surface to be cleaned. The flap is therefore equal in peripheral size to the packet.

Figure 5:
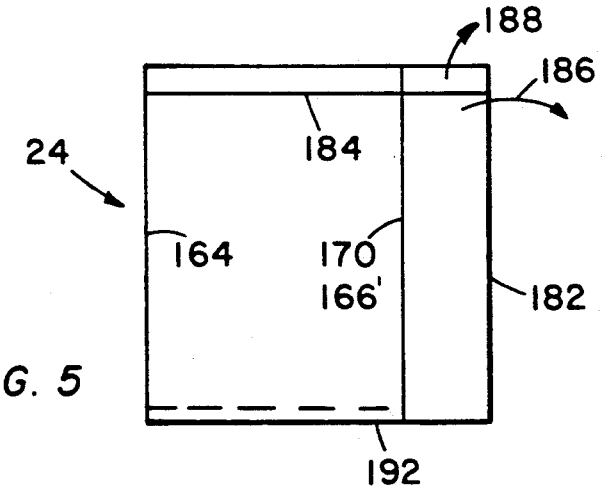
FIG. 5 is a front elevational view of a disposal bag of the present invention in a folded configuration.
Figure 6:
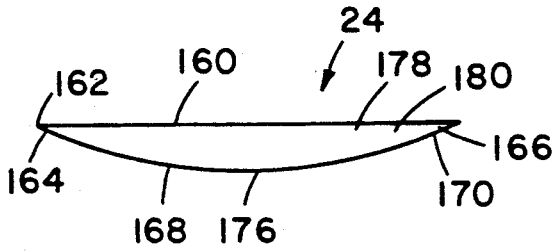
FIG. 6 is a top plan view of the disposal bag in an open configuration.

As shown in FIGS. 1, 5 and 6, the bag unit 24 includes a bottom ply 160 having adhesive 162 thereon for releasably and fixing that ply to the sponge element in an airtight manner to prevent the liquid disinfectant in the sponge element from evaporating during storage. The adhesive extends along at least the two side edges 164 and 166 of the bottom ply. In one form of the implement, the adhesive extends along all peripheral edges of the bag and engages the sponge. In another form, the adhesive engages the top rim 56 of the wall 38. A top ply 168 that is attached to the bottom ply along side edges 170 thereof which are attached to the bottom ply side edges, and along a bottom edge 172 thereof that is attached to the bottom flap bottom edge. Top edges 176 and 178 of the top and bottom plys respectively are unattached and can move apart from each other to define a mouth 180. The bag mouth is opened to receive the implement after that implement has been used and is to be discarded.

The bag unit 24 includes two foldlines 182 and 184 respectively extending between the end edges and the side edges of the bag unit. The bag unit is folded so that it will have the same peripheral size as the sponge unit for storage, and is unfolded as indicated by arrows 186 and 188 to enlarge that bag unit so it can accommodate the implement after use. A line of adhesive 192 attaches the end edges of the bag unit to the sponge so the bag unit, with the bottom end edges attached to each other, can be removed from the sponge. Once the bag unit is removed from the sponge element, it is unfolded and opened, and the cleaning implement can be inserted thereinto for disposal. The preferred form of the bag unit includes aluminum plys.

Figure 7:
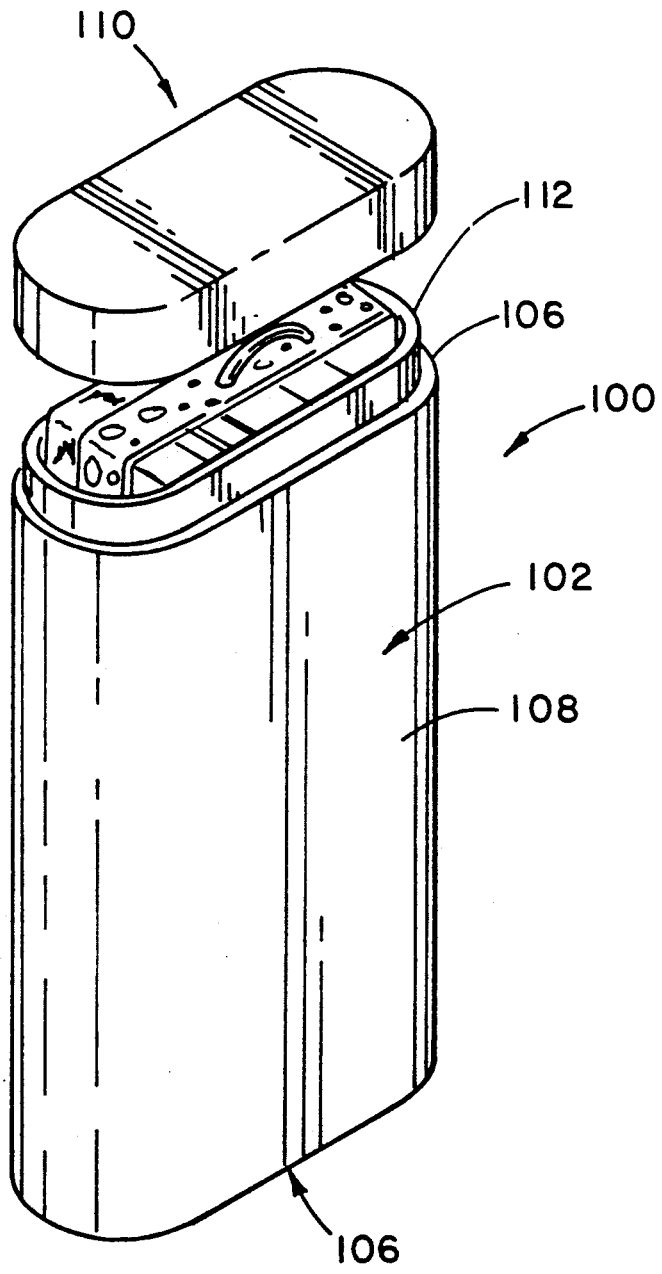
FIG. 7 is a perspective view of an alternative form of the implement.
Figure 8:
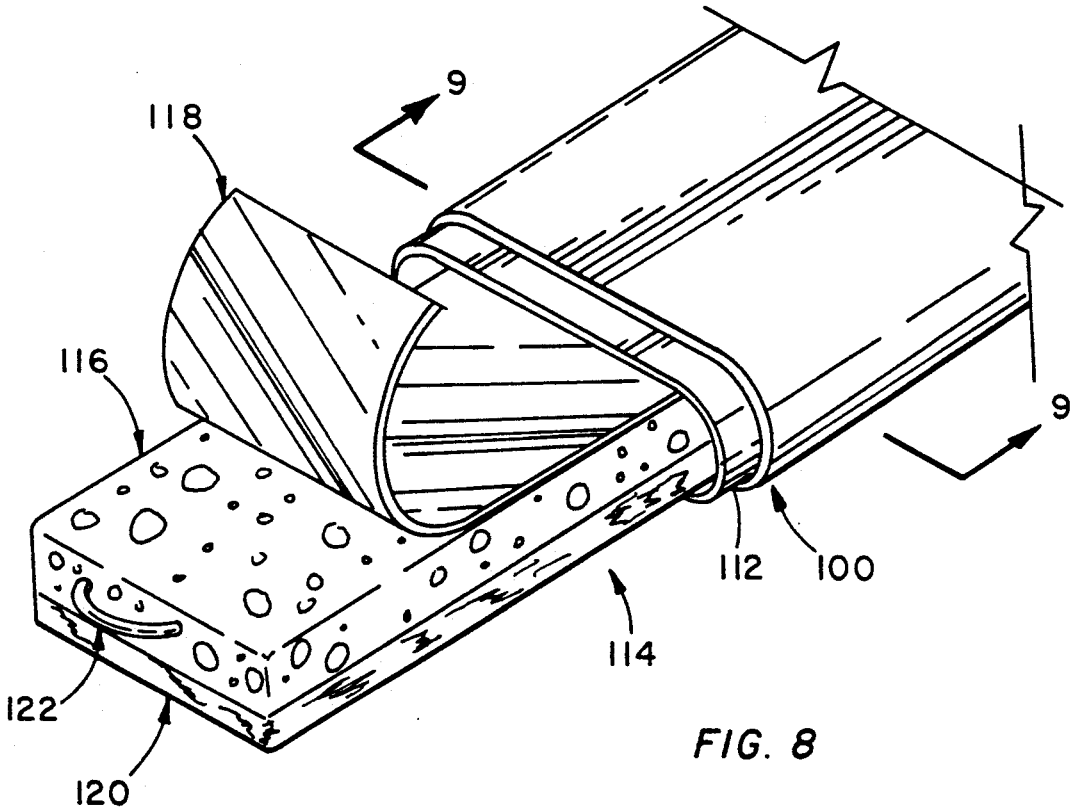
FIG. 8 is a perspective view of the alternative form of cleaning implement in an open condition.
Figure 9:
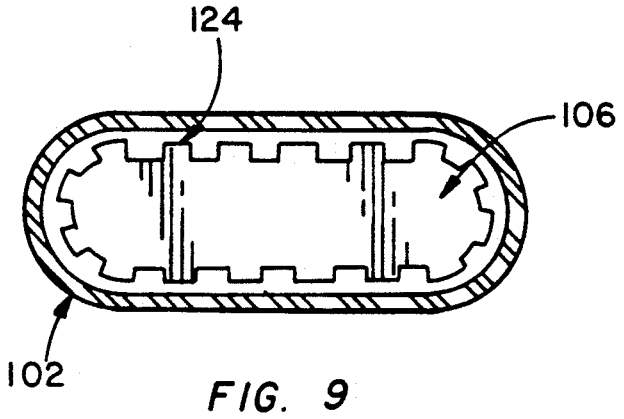
FIG. 9 is an elevational view taken along line 9—9 of FIG. 8.

An alternative form of the cleaning implement is shown in FIGS. 7, 8 and 9. The alternative implement 100 is self-contained yet is still pocket sized. The implement 100 includes an outer case 102 having a closed bottom wall 104, an open top 106 and an oval wall 108 connecting the bottom wall to the open top. A closure top 110 is also included.

As shown in FIGS. 7 and 8, the implement 100 also includes a liner 112. A cleaning unit 114 is slidably mounted inside the case and includes a disinfectant-soaked sponge 116. Metal foil 118, such as aluminum or the like, is positioned on one side of the sponge, and a dry cloth 120 is positioned on the other side of the sponge. A second layer of metal foil can be interposed between the sponge and the cloth if the disinfectant in the sponge is liquid. A pull handle 122 is secured to the sponge so the cleaning unit can be pulled out of the case for use. As is shown in FIG. 9, the case has a plurality of grooves 124 to guide the cleaning unit into and out of the case.

It is understood that while certain forms of the present invention have been illustrated and described herein, it is not to be limited to the specific forms or arrangements of parts described and shown.

I claim:

1. A cleaning implement comprising:

A) a handle unit which comprises
- (1) a head section having a first end edge, a second end edge, two side edges connecting said end edges together, a front surface and a rear surface,
- (2) two front hinge ears connected to said head section front surface adjacent to said head section first end edge,
- (3) two rear hinge ears connected to said head section rear surface adjacent to said head section first end edge,
- (4) a sponge element fixed to said head section front surface, and
- (5) a drying cloth element fixed to said head section rear surface;

B) a front cover unit which includes
- (1) a first end edge, a second end edge, two curved side edges connecting said front cover unit end edges together, an outer surface and an inner surface,
- (2) two hinge ears connected to said front cover unit inner surface adjacent to said cover unit first end edge,
- (3) a pivot pin pivotally connecting each front cover unit hinge ear to one of said head section front hinge ears;

C) a rear cover unit which includes
- (1) a first end edge, a second end edge, two curved side edges connecting said rear cover unit end edges together, an outer surface and an inner surface,
- (2) two hinge ears connected to said rear cover unit inner surface adjacent to said cover unit first end edge,
- (3) a pivot pin pivotally connecting each rear cover unit hinge ear to one of said head section rear hinge ears;

D) a top unit which includes
- (1) a hinge means on said rear cover unit second end edge,
- (2) a bottom wall having two ends and two sides connecting said bottom wall ends together, one of said bottom wall sides being connected to said top unit hinge means, and
- (3) a side wall connected to said bottom wall;

E) locking means for locking said front cover unit to said rear cover unit and including a male snap element on said rear cover unit outer surface and a female snap element on said front cover unit outer surface;

F) a bag unit for covering said sponge element and for containing a used cleaning implement, said bag unit including
- (1) first and second end edges, first and second side edges connecting said bag unit end edges together,
- (2) a foldline extending between said bag unit end edges adjacent to said bag unit first side edge,
- (3) a line of adhesive extending between bag unit side edges adjacent to said bag unit first end edge and releasably attaching said bag unit to said sponge element,
- (4) a top ply and a bottom ply, said top ply and said ply being joined together along said side edges and along said bag unit second end edge, said top and bottom plys co-operating to define a chamber therebetween, and
- (5) adhesive means releasably fixing said bag unit side edges to said sponge element; and G) a detergent container and dispenser which includes
- (1) a rear surface,
- (2) a front surface connected to said rear surface and forming a chamber therewith,
- (3) a multiplicity of perforations through said detergent container and dispenser front surface,
- (4) a flap attached at one end thereof to one end of said detergent container and dispenser front surface and,
- (5) adhesive means releasably fixing said flap to said detergent container and dispenser front surface in overlying said detergent container and dispenser front surface in covering relation to said perforations, and
- (6) second means fixing said detergent container and dispenser rear surface to said front cover unit inner surface.

2. The cleaning implement defined in claim 1 further including a grasping button on said top unit side wall.

3. The cleaning implement defined in claim 2 further including a head section wall connected to said head section side edges and to said head section end edges.

4. The cleaning implement defined in claim 3 wherein said bag unit is formed of aluminum.

5. The cleaning implement defined in claim 4 further including adhesive on said bag unit bottom ply for releasably engaging said head section wall and sealing said sponge element into said head section in an air-tight manner.

6. The cleaning implement defined in claim 5 further including a second foldline on said bag unit, said second foldline extending between said bag unit first and second side edges adjacent to said bag unit second end edge.

7. The cleaning implement defined in claim 5 wherein said bag element adhesive means is located on all peripheral edges of said bag bottom ply.

8. The cleaning implement defined in claim 3 wherein said bag element adhesive means engages said head section wall.

* * * * *